US011406147B2

(12) United States Patent
Sohn

(10) Patent No.: US 11,406,147 B2
(45) Date of Patent: Aug. 9, 2022

(54) HAIRBAND FOR GUIDING SWEAT

(71) Applicant: N-RIT CO., LTD., Paju-si (KR)

(72) Inventor: Dae Up Sohn, Paju-si (KR)

(73) Assignee: N-RIT CO., LTD., Paju-si (KR)

( * ) Notice: Subject to any disclaimer, the term of this patent is extended or adjusted under 35 U.S.C. 154(b) by 216 days.

(21) Appl. No.: 16/629,417

(22) PCT Filed: Jul. 11, 2018

(86) PCT No.: PCT/KR2018/007843
§ 371 (c)(1),
(2) Date: Jan. 8, 2020

(87) PCT Pub. No.: WO2019/017639
PCT Pub. Date: Jan. 24, 2019

(65) Prior Publication Data

US 2020/0196690 A1 Jun. 25, 2020

(30) Foreign Application Priority Data

Jul. 19, 2017 (KR) ..... 10-2017-0091567

(51) Int. Cl.
*A42C 5/02* (2006.01)
*A41D 20/00* (2006.01)
*A45D 8/36* (2006.01)

(52) U.S. Cl.
CPC ..... *A41D 20/00* (2013.01); *A42C 5/02* (2013.01); *A45D 8/36* (2013.01)

(58) Field of Classification Search
CPC ..... A42C 5/02; A41D 20/00; Y10S 2/11
See application file for complete search history.

(56) References Cited

U.S. PATENT DOCUMENTS 1,392,539 A * 10/1921 Tipograph ..... A42C 5/02 2/181
2,320,782 A * 6/1943 Larsen ..... A41D 20/00 2/171

(Continued)

FOREIGN PATENT DOCUMENTS

JP 2002-201525 A 7/2002
KR 20-1998-0061440 U 11/1998

(Continued)

*Primary Examiner* — Tajash D Patel
(74) *Attorney, Agent, or Firm* — Novick, Kim & Lee, PLLC; Jae Youn Kim

(57) ABSTRACT

The present invention relates to a hairband for guiding sweat, which can guide and discharge sweat running down from a user's head area to a user's forehead area so as to prevent the sweat from reaching eye areas during exercise or working. A hairband for guiding sweat, which is flexibly worn on a user's forehead area and guides sweat, the hairband may comprise: a band part including a first band member and a second band member, each of which includes a coupling member which may be coupled to and mounted on the user's forehead area; and a sweat guiding part disposed between the first band member and the second band member, wherein the band part and the sweat guiding part are integrally formed. Therefore, the hairband can simplify a manufacturing process and thus reduce a manufacturing cost.

18 Claims, 13 Drawing Sheets

(56) References Cited

U.S. PATENT DOCUMENTS

| | | | | | |
|---|---|---|---|---|---|
| 4,941,210 | A * | 7/1990 | Konucik | A41D 27/13 | 2/171 |
| 5,432,955 | A * | 7/1995 | Plotka | A42C 5/02 | 2/181 |
| 6,353,936 | B2 * | 3/2002 | Flatt | A41D 20/00 | 2/174 |
| 6,584,984 | B2 * | 7/2003 | Kelly | A45D 8/36 | 132/212 |
| 7,398,559 | B2 | 7/2008 | Flatt | | |
| 8,296,866 | B2 * | 10/2012 | Kelly | A41D 20/00 | 2/181 |
| 9,009,869 | B1 | 4/2015 | Shapiro et al. | | |
| 2008/0263751 | A1 | 10/2008 | Flatt | | |
| 2018/0153245 | A1 * | 6/2018 | Pannikottu | A63B 71/081 | |
| 2019/0075878 | A1 * | 3/2019 | Abraham | B32B 25/20 | |

FOREIGN PATENT DOCUMENTS

| | | | |
|---|---|---|---|
| KR | 20-0459163 | Y1 | 3/2012 |
| KR | 20-2012-0006044 | U | 8/2012 |
| KR | 20-0462551 | Y1 | 9/2012 |
| KR | 20-0462976 | Y1 | 10/2012 |

* cited by examiner

HAIRBAND FOR GUIDING SWEAT

TECHNICAL FIELD

The present invention relates to a hairband for guiding sweat that is capable of guiding and discharging sweat running down from a head area of a user to a forehead area of the user so that the sweat does not reach eye areas of the user during exercise or work.

BACKGROUND ART

Generally, when working outdoors, climbing, or exercising, a large amount of sweat is released according to the physical activity. Sweat consists mainly of water but also contains components such as urea, uric acid, and fatty acid. Sweat comes out to regulate body temperature when doing exercise such as running a marathon, jogging, cycling, and mountain climbing or performing work outdoors. When a small amount of chemical components that the sweat contains enters the eyes, the chemical components cause pain in the eyes and blur the field of vision, thus becoming an obstacle to exercise or mountain climbing.

Accordingly, when doing exercise such as running a marathon, jogging, cycling, mountain climbing, and physical fitness, sometimes, a hairband for absorbing sweat is worn on the head, among the body parts, to prevent sweat from running down from the forehead to the face. In such hairbands, mostly, a sweatband part is formed of a fiber material and absorbs some of the sweat, but this is not functionally enough to absorb the sweat coming out continuously. Also, there is a problem in that, when the sweatband part is soaked with sweat, the sweatband formed of a smooth material may harden or be deformed due to the sweat, causing a user to feel uncomfortable, and thus a person who is sensitive may just take off the hairband.

Examples of technologies for addressing the above problems have been disclosed in the following documents or the like.

For example, U.S. Pat. No. 7,398,559 (Jul. 15, 2008) has disclosed a hairband device in which a substantially non-absorbing band includes a front band part and two side band parts, a drain structure is provided to extend from an outer side surface of the band, the drain structure includes a drain base and a drain lip, the drain structure which is coupled to at least a portion of the front band part and the first and second side band parts forms a sweat channel having a substantially U-shaped cross-section, the drain base has a central portion having a first thickness and an end portion having a second thickness, the first thickness is larger than the second thickness, the drain base is inclined downward from the central portion toward the end portion such that sweat flows from the central portion having the first thickness to the end portion having the second thickness, and a fastening structure has two fasteners and an elastic loop member.

Also, U.S. Pat. No. 9,009,869 (Apr. 21, 2015) has disclosed a sweat guiding device that may be attached to a wearer by an adhesive, the sweat guiding device having a structure that allows the sweat guiding device to be attached to a portion (forehead area) of the face without wrapping around the head, includes a first leg and a second leg which are coupled to each other at a base of the device to form a channel therebetween, and is used by being adhered to the forehead of the wearer.

Also, Korean Patent Registration No. 20-0462551 (Date of Registration: Sep. 10, 2012) has disclosed a sweat discharging cap including a sweat discharging band coupled to an inner front surface of the sweat discharging cap, wherein the sweat discharging band includes a first band member whose one side surface is coupled to the inner front surface of the sweat discharging cap, a second band member whose one side surface presses against the forehead, and an extension which connects a lower end of the other side surface of the first band member and a lower end of the other side surface of the second band member and forms a ditch between the first band member and the second band member.

Also, Korean Patent Registration No. 20-0462976 (Date of Registration: Oct. 5, 2012) has disclosed a sweatband including, as illustrated in FIG. 1, a hairband 100 which is elastic and worn on the head, a sweat overflow preventing protrusion 200, and a sweat drain groove, wherein the sweat drain groove is formed to extend from a central portion of the front of the hairband to central portions of both side surfaces of the hairband so that sweat running down from the forehead is accommodated in the sweat drain groove and discharged, a sweat discharge part 240 through which sweat transferred through the sweat drain groove is discharged is formed at both end portions of the sweat overflow preventing protrusion 200, and the sweat overflow preventing protrusion 200 includes a sweat guiding part which extends forward from a lower end of the hairband and a sweat overflow preventing part which is formed to extend upward from an end portion of the sweat guiding part and provided in a shape corrugated in a zigzag shape in front and rear directions so that corrugated grooves configured to be filled with sweat are formed at an inner side of the sweat overflow preventing part.

DISCLOSURE

Technical Problem

However, in the technology disclosed in U.S. Pat. No. 7,398,559, since the thickness of the central portion of the drain structure provided in a U-shape is thick and a skin contact part is formed higher than a drain part in the front band part, there is a problem in that, when excessive sweat is discharged, the sweat may overflow and reach the eye areas of a user, and, since an elastic loop member and a hook fastener have to be provided separately from the band parts, there is a problem in that a manufacturing process becomes complicated. Also, the drain part is formed to have a shorter length than the skin contact part, and the drain part is provided at an outer side of the skin contact part, and thus there is a problem in that sweat runs down the facial area after being discharged through the drain part.

Also, in the technology disclosed in U.S. Pat. No. 9,009,869, since the structure is attached to the eye areas of a user by an adhesive member, there are problems in that the user feels uncomfortable due to the adhesive member, repeated use is not possible, and the adhesive member is highly likely to be detached from the user's skin.

Also, in the technology disclosed in Korean Patent Registration No. 20-0462551, since a dedicated cap has to be used and a band is mounted on the cap, in order to allow smooth discharge of sweat, the cap should be worn down to the eyebrows of a user. Accordingly, the field of vision is blocked by a brim of the cap, and, during use of the cap, a position of the band changes according to a change in a position of the cap, thus causing a problem in that it is difficult to properly perform the sweat discharge function. Meanwhile, since the sweat discharge function can be performed only when the cap is worn, there is a problem in that, when the cap comes off during intense exercise, it is not possible to properly perform the sweat discharge function, and there is a problem in that the utility of the cap is degraded because users generally do not wear a cap during indoor exercise such as doing fitness. Also, when, due to discharge of excessive sweat, a user feels uncomfortable wearing the cap and thus takes off the cap, there is a problem in that the sweat discharge function cannot be performed at all. In addition, there is a problem in that the band member has to be made larger than necessary in order to mount the band on the cap.

Also, in the technology disclosed in Korean Patent Registration No. 20-0462976, since a portion of the preventing protrusion 200 in which the plurality of corrugated grooves are provided is formed lower than the hairband 100, there is a problem in that, as mentioned above in relation to Patent Document 1 (U.S. Pat. No. 7,398,559), when excessive sweat is discharged, the sweat may overflow and reach the eye areas of a user. Also, since a hoop-and-loop fastener and a fixing ring have to be provided, there is a problem in that a manufacturing process becomes complicated.

The present invention has been devised to address the above-mentioned problems and is directed to providing a hairband for guiding sweat that is capable of simplifying a manufacturing process because a band part and a sweat guiding part are integrally formed.

The present invention is also directed to providing a hairband for guiding sweat that is capable of, after being worn using a double fastening structure, stably staying in place without falling down or loosening.

The present invention is also directed to providing a hairband for guiding sweat that is capable of improving a degree of adhesion between the hairband and a forehead area of a user so that smooth discharge of sweat is guided and a pleasant use environment is maintained.

Technical Solution

One aspect of the present invention provides a hairband for guiding sweat that is elastic and worn on a forehead area of a user to guide sweat, the hairband including a fastening member which is mountable on the forehead area of the user by being fastened thereto and includes a first fastening part and a second fastening part, a band part which includes a first band member including the first fastening part and a second band member including the second fastening part, and a sweat guiding part provided between the first band member and the second band member, wherein the fastening member, the band part, and the sweat guiding part are integrally formed.

In the hairband according to the present invention, the sweat guiding part may include a first guiding member whose one side surface presses against the forehead area of the user, a sweat leading part provided continuously with the first guiding member at a lower portion of the first guiding member, and a second guiding member provided continuously with the sweat leading part while being spaced apart from the first guiding member.

In the hairband according to the present invention, the first band member, the second guiding member, and the second band member may be integrally formed continuously with each other.

In the hairband according to the present invention, a height of the second guiding member may be formed higher than a height of the first guiding member.

In the hairband according to the present invention, a plurality of first protrusions may be provided at a lower portion of an outer side of the first guiding member so that a gap is formed between the forehead area of the user and the first guiding member.

In the hairband according to the present invention, a plurality of second protrusions may be provided at an inner side of the second guiding member so that the first guiding member and the second guiding member remain spaced apart from each other.

In the hairband according to the present invention, a width of the sweat leading part at both end portions of the first guiding member may be formed narrower than a width of the sweat leading part at a central portion of the first guiding member.

In the hairband according to the present invention, the sweat guiding part may be formed of a central portion and both end portions and formed to be gradually inclined from the central portion toward the both end portions.

In the hairband according to the present invention, the sweat guiding part may be formed to be inclined 5 to 30° with respect to the band part.

In the hairband according to the present invention, a plurality of sweat outlets may be provided in the first guiding member.

In the hairband according to the present invention, an upper portion of the first guiding member may be formed in a wavy shape including ridges and valleys.

In the hairband according to the present invention, the ridge of the wavy shape may have the same height as the second guiding member, and the valley of the wavy shape may be provided to be lower than the second guiding member.

In the hairband according to the present invention, the fastening member may perform double fastening to mount the hairband on the forehead area of the user.

In the hairband according to the present invention, the fastening member may include a first fixing protrusion formed at an end portion of the first band member, a second fixing protrusion formed at an end portion of the second band member, and a plurality of fastening holes provided at each of the first band member and the second band member so that the first and second fixing protrusions are coupled, wherein, in the first band member, a through hole through which a portion of the second band member passes is provided so that the second fixing protrusion is fastened to the plurality of fastening holes of the first band member.

In the hairband according to the present invention, at least one hole may be provided in each of the first band member and the second band member so as to allow a mounting position of the hairband to be easily adjusted.

In the hairband according to the present invention, the both end portions of the first guiding member may be provided to be adjacent to the holes each provided in the first band member and the second band member.

In the hairband according to the present invention, a sweat discharging member may be connected to both end portions of the sweat leading part.

In the hairband according to the present invention, the upper portion of the first guiding member may be bent outward.

In the hairband according to the present invention, the band part and the sweat guiding part may be formed of rubber or resin having elasticity.

Advantageous Effects

According to a hairband for guiding sweat according to the present invention, since a band part, which includes a fastening member, and a sweat guiding part are integrally formed by a mold, a manufacturing process can be simplified, and thus an effect of reducing a manufacturing cost is achieved.

According to the hairband for guiding sweat according to the present invention, since the fastening member is integrally provided with the band part, an effect of preventing damage or loss of the fastening member is also achieved.

According to the hairband for guiding sweat according to the present invention, since an upper portion of a first guiding member is formed in a wavy shape including ridges and valleys, an effect of smoothly guiding sweat is also achieved by allowing sweat running down from a forehead area to flow from the ridge toward the valley and then flow to a sweat leading part.

According to the hairband for guiding sweat according to the present invention, by providing a double fastening part, the hairband can be prevented from falling down or loosening during use, and thus an effect of allowing the hairband to stably maintain a circular shape which fits a head circumference of a user is also achieved.

According to the hairband for guiding sweat according to the present invention, by providing at least one circular hole in a first band member and a second band member, when the hairband is worn on a head area of a user, effects of allowing a mounting position of the hairband to be easily adjusted while improving the wearability of the hairband are also achieved.

MODES OF THE INVENTION

The above-mentioned and other objectives and new features of the present invention will become more apparent by the description herein and the accompanying drawings.

In describing a structure of a hairband for guiding sweat according to the present invention, for convenience of description, each part of the hairband for guiding sweat that is formed as one body will be separately described.

Hereinafter, embodiments of the present invention will be described with reference to the drawings.

First Embodiment

A hairband for guiding sweat according to a first embodiment of the present invention will be described with reference to FIGS. 2 to 5.

Figure 1:
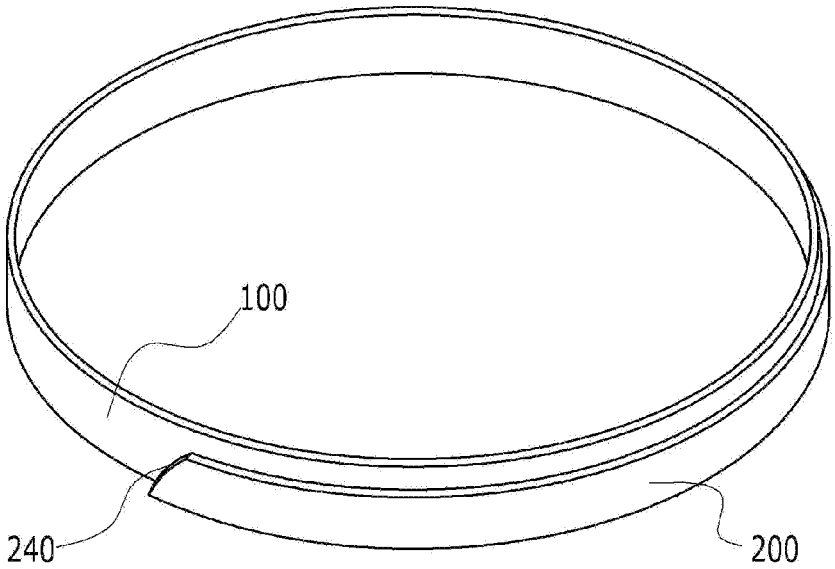
FIG. 1 PRIOR ART
FIG. 1 is a perspective view of a sweatband having a sweat overflow preventing function according to the related art.
Figure 2:
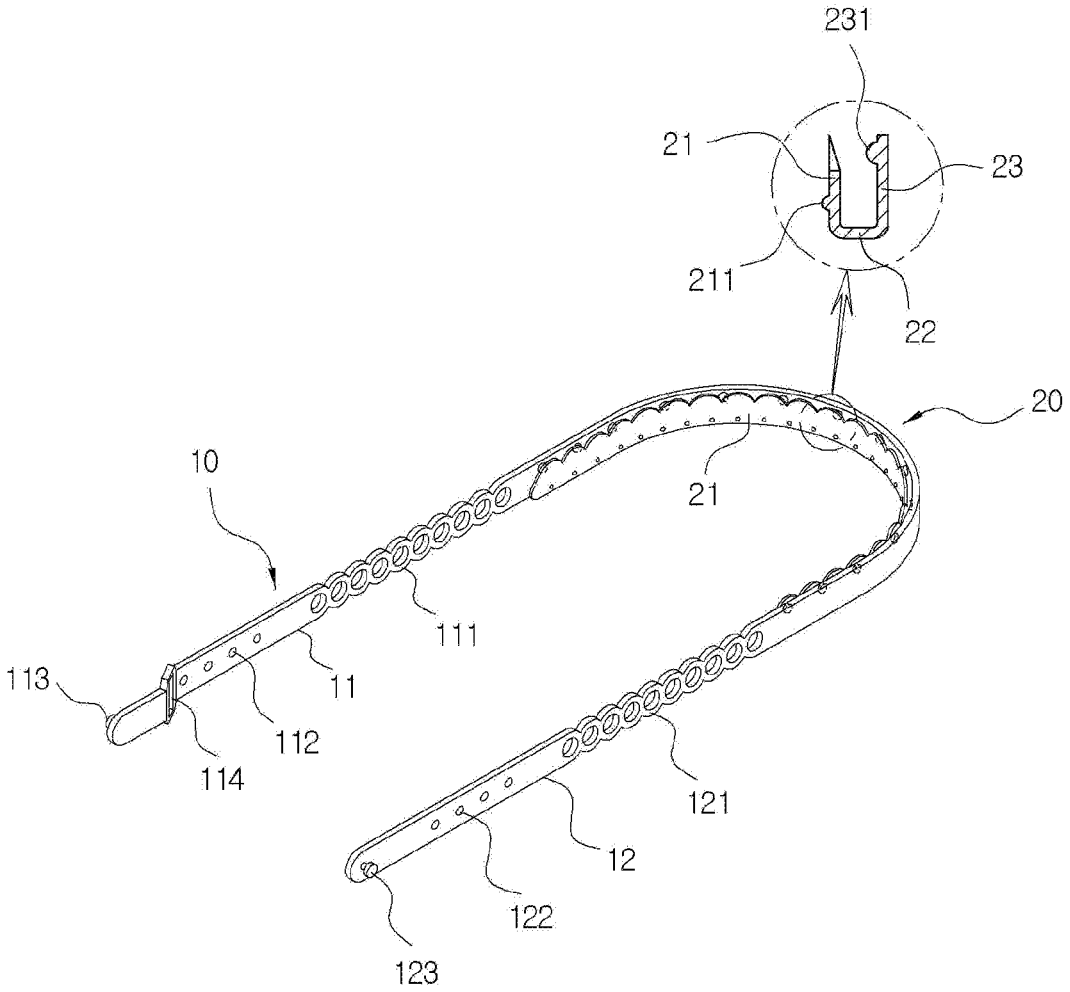
FIG. 2 is a perspective view of a hairband for guiding sweat according to a first embodiment of the present invention.
Figure 3:
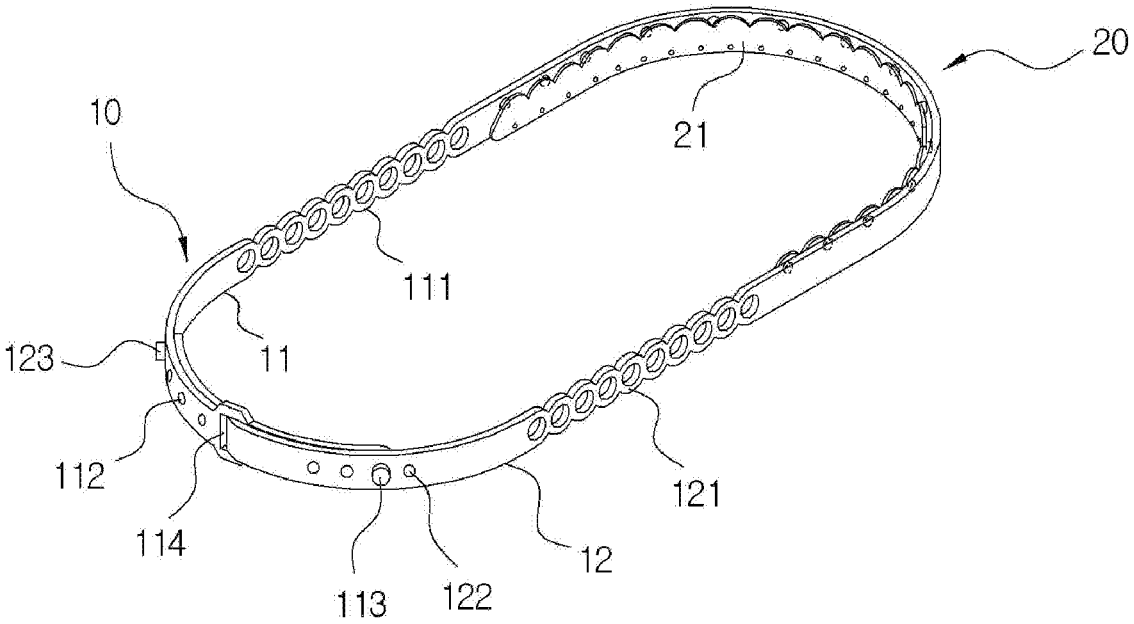
FIG. 3 is a fastening state view of the hairband for guiding sweat that is illustrated in FIG. 2.
Figure 4:
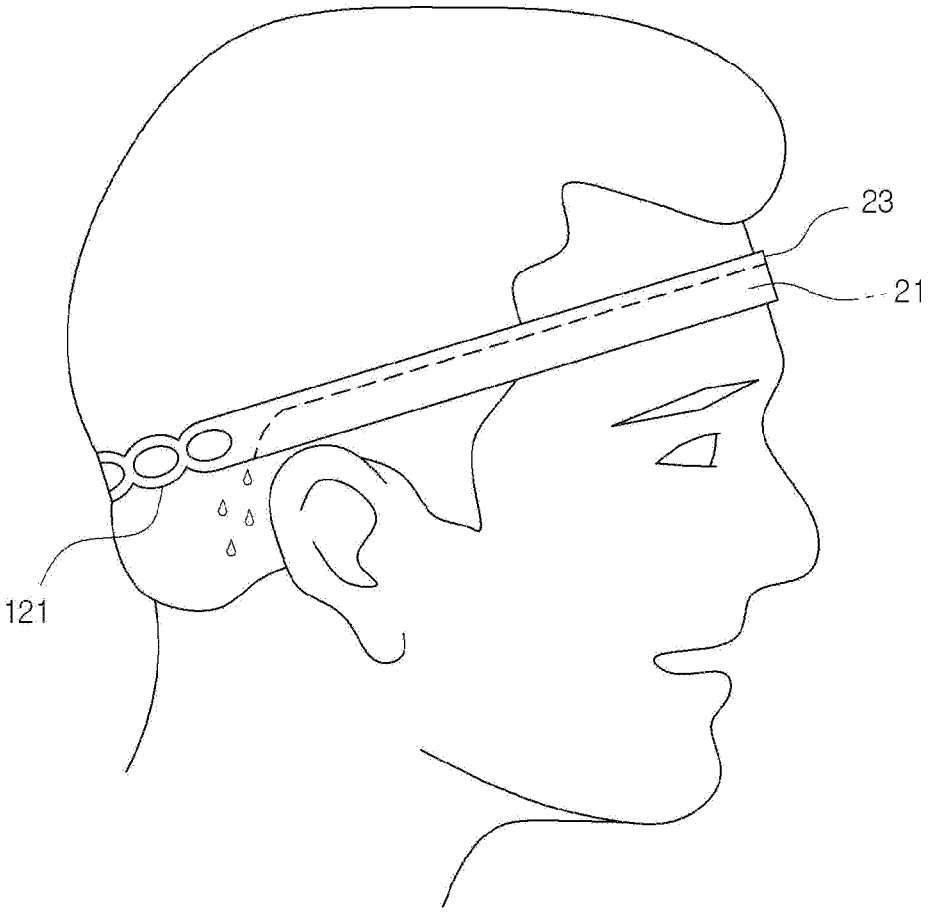
FIG. 4 is a use state view of the hairband for guiding sweat that is illustrated in FIG. 2.
Figure 5:
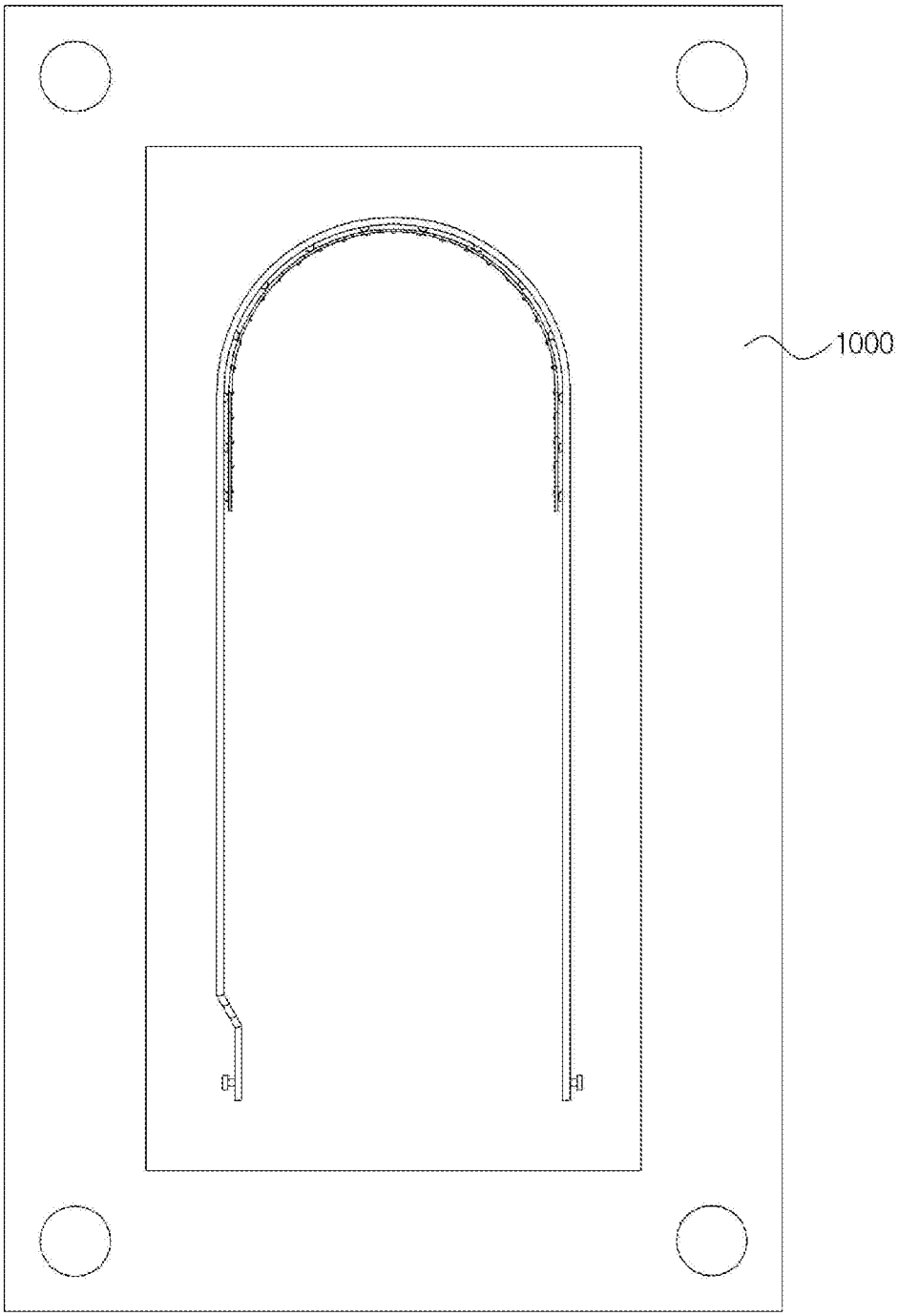
FIG. 5 is a view illustrating an example of a mold for forming the hairband for guiding sweat that is illustrated in FIG. 2 as one body.

FIG. 2 is a perspective view of the hairband for guiding sweat according to the first embodiment of the present invention, FIG. 3 is a fastening state view of the hairband for guiding sweat that is illustrated in FIG. 2, FIG. 4 is a use state view of the hairband for guiding sweat that is illustrated in FIG. 2, and FIG. 5 is a view illustrating an example of a mold for forming the hairband for guiding sweat that is illustrated in FIG. 2 as one body.

As illustrated in FIG. 2, the hairband for guiding sweat according to the present invention, which is a hairband for guiding sweat that is elastic and worn on a forehead area of a user to guide the sweat, includes a band part 10 including a fastening member mountable on the forehead area of the user by being fastened thereto and including a first band member 11 and a second band member 12 and a sweat guiding part 20 provided between the first band member 11 and the second band member 12, wherein the band part 10 and the sweat guiding part 20 constitute a non-separable structure and are integrally formed. That is, the band part 10 and the sweat guiding part 20 may be integrally formed by, for example, a mold 1000 as illustrated in FIG. 5, but the present embodiment is not limited thereto, and the band part 10 and the sweat guiding part 20 may also be integrally formed using a method such as thermal compression.

The band part 10 and the sweat guiding part 20 may be formed of rubber or resin having elasticity. Silicone resin or a flexible plastic material may be used as the resin. Preferably, the band part 10 and the sweat guiding part 20 may be integrally formed by a general mold using silicone resin which is water-repellant and physiologically harmless. When the hairband for guiding sweat according to the present invention is provided as one body by a mold or the like using silicone resin which is harmless to the human body and has a hardness as similar as possible to that of the human skin, discomfort due to the skin being pressed by the hairband may be eased, and since manufacturing the hairband is completed by a single process, a manufacturing cost can be reduced. That is, in the present invention, by integrally forming the band part 10, which includes a fastening member, and the sweat guiding part 20 by a mold or the like as illustrated in FIG. 5, it is possible to address the problem of a conventional headband device or the like in that the manufacturing process is complicated and thus a manufacturing cost is increased due to an elastic loop member, a hoop fastener, and the like being provided separately from a band part.

As illustrated in FIG. 2, the sweat guiding part 20 includes a first guiding member 21 whose one side surface presses against the forehead area of the user, a sweat leading part 22 provided continuously with the first guiding member 21 at a lower portion of the first guiding member 21, and a second guiding member 23 provided continuously with the sweat leading part 22 while being spaced apart from the first guiding member 21. As can been seen from a cross-sectional view, which is an enlarged portion, in FIG. 2, the sweat guiding part 20 is provided as one body with a substantially U-shaped cross-section.

In the present invention, an outer side of the first guiding member 21 indicates a portion coming in contact with a forehead area of a user during use, an inner side of the first guiding member 21 indicates a portion facing the sweat leading part 22, and an inner side of the second guiding member 23 indicates a portion facing the sweat leading part 22.

Also, as illustrated in FIG. 2, an upper portion of the first guiding member 21 is formed in a wavy shape including ridges and valleys, each of which are provided to be inclined toward the sweat leading part 22. Also, the ridge portion of the wavy shape has substantially the same height as the second guiding member 23, and the valley portion of the wavy shape is provided to be lower than the second guiding member 23. However, the present embodiment is not limited thereto, and the height of the second guiding member 23 may be formed higher than the height of the first guiding member 21. That is, by providing the ridge portion of the first guiding member 21 to be lower than the second guiding member 23, when excess sweat is discharged, the sweat may be prevented from overflowing the second guiding member 23 and reaching eye areas of the user. Therefore, sweat running down from the forehead area of the user is allowed to easily flow to the sweat leading part 22 along the inner side of the first guiding member 21.

As illustrated in FIG. 2, according to the hairband for guiding sweat according to the present invention, because the sweat that reached the forehead area through a gradient having a wavy shape flows from the ridge toward the valley and then flows to the sweat leading part 22, smooth sweat flow is guided in the hairband for guiding sweat. That is, while, in the related art, when drops of sweat running down from a forehead area are small, the drops of sweat flow along an upper portion of the hairband without being guided to a sweat leading part, in the present invention, because the upper portion of the first guiding member 21 is provided to have the gradient having the wavy shape, drops of sweat that reached the ridge portion immediately flow to the valley portion and are guided to the sweat leading part 22, and the drops of sweat that reached the valley portion are only guided to the sweat leading part 22 due to blocking by the ridge portion. That is, unlike the related art, the hairband for guiding sweat according to the present invention may prevent the occurrence of a state in which drops of sweat flow along an upper portion of the hairband.

Also, as illustrated in FIG. 2, a plurality of first protrusions 211 may be provided at a lower portion of the outer side of the first guiding member 21, which is the portion coming in contact with the forehead area of the user, so that a gap is formed between the forehead area of the user and the first guiding member 21.

By the plurality of first protrusions 211 being provided at predetermined intervals at the lower portion of the outer side of the first guiding member 21, a surface in contact with the skin of the forehead area of the user may be minimized, and thus a sense of the forehead being pressed and discomfort being caused when wearing the hairband may be minimized. Also, by forming a small gap between the skin of the forehead area of the user and the first guiding member 21 and allowing communication with outside air, a pleasant use environment may be maintained. Also, the plurality of first protrusions 211 may prevent the first guiding member 21 from sliding down from the forehead area while the hairband is worn, improve a degree of adhesion between the forehead area and the ridge and valley portions formed at the upper portion of the first guiding member 21 and guide smooth sweat flow, and prevent the sweat from leaking through the outer side of the first guiding member 21 and reaching the eye areas along the face.

In the hairband for guiding sweat according to the present invention, as illustrated in FIG. 2, the first band member 11, the second guiding member 23, and the second band member 12 are integrally formed continuously with each other. A plurality of second protrusions 231 are provided at an upper portion of the inner side of the second guiding member 23 so that the first guiding member 21 and the second guiding member 23 remain spaced apart from each other. By providing the plurality of second protrusions 231, while the hairband for guiding the sweat that is formed of rubber or silicone resin having elasticity is worn, the hairband is prevented from stretching at the forehead area of the user, thus preventing the first guiding member 21 and the second guiding member 23 from pressing against each other. In this way, the sweat guided to the inner side of the first guiding member 21 is guided to the sweat leading part 22. Also, although the structure in which the plurality of second protrusions 231 are provided at the upper portion of the inner side of the second guiding member 23 is illustrated in FIG. 2, the present embodiment is not limited thereto. The plurality of second protrusions 231 may also be provided at a central portion of the inner side of the second guiding member 23 or provided at the inner side of the first guiding member 21.

Also, in the hairband for guiding sweat according to the present invention, as illustrated in FIG. 2, both end portions of the first guiding member 21 are formed to be inclined toward the first band member 11 and the second band member 12. That is, at the both end portions of the first guiding member 21, by the last valley portion being provided to be inclined toward a lower end of the first guiding member 21, the sweat guided to the sweat leading part 22 is discharged from the sweat guiding part 20.

As illustrated in FIG. 4, the first guiding member 21 is provided to extend to the back of the ears of the user so that the sweat is discharged to the head area of the user.

As illustrated in FIG. 2, one or more circular holes 111 and 121 for allowing a mounting position of the hairband to be easily adjusted are provided in the first band member 11 and the second band member 12, respectively, which are provided continuously with both sides of the second guiding member 23 of the sweat guiding part 20. Although FIG. 2 illustrates a structure in which ten holes are provided in each of the first band member 11 and the second band member 12, the present embodiment is not limited thereto, and the number of holes may be increased or decreased according to a material forming the hairband for guiding sweat. The circular holes 111 and 121 not only improve wearability of the hairband due to being stretchable, but also keep the hairband fresh by being air-permeable and thus guiding air circulation. That is, when the hairband is worn on the head area of the user, the circular holes 111 and 121 are deformed to an elliptical shape as illustrated in FIG. 4, thereby not only improving the wearability of the hairband but also allowing the mounting position of the hairband to be easily adjusted. For example, when the user mounts the hairband for guiding sweat according to the present invention on the forehead area and then adjusts the mounting position of the hairband by, while holding the sweat guiding part 20 by hand, pulling the hairband forward and moving the hairband vertically, the user may adjust the mounting position of the hairband as the circular holes 111 and 121 and stretch and are deformed to the elliptical shape as illustrated in FIG. 4.

In the hairband for guiding sweat according to the present invention, because, as described above, the second guiding member 23 is formed longer than the first guiding member 21, and, as illustrated in FIGS. 2 and 4, the both end portions of the first guiding member 21 are provided to be adjacent to the holes 111 and 121 which are provided in the first band member 11 and the second band member 12, respectively, the sweat guided to the sweat leading part 22 is prevented from dropping to the facial area of the user.

Also, even when the user lowers his or her head in a process in which sweat is discharged while the user is wearing the hairband for guiding sweat according to the present invention, because the second guiding member 23 is formed longer than the first guiding member 21, both sides of the second guiding member 23 are provided continuously with the first band member 11 and the second band member 12, and the first guiding member 21 is provided to extend to the back of the ears of the user, the sweat is prevented from being discharged to the facial area of the user.

A fastening member is provided continuously with end portions of the first band member 11 and the second band member 12.

The fastening member includes a double fastening part formed of a first fastening part and a second fastening part for mounting the hairband on the forehead area of the user. As illustrated in FIG. 2, the double fastening part includes a first fixing protrusion 113 formed at an end portion of the first band member 11, a second fixing protrusion 123 formed at an end portion of the second band member 12, and a plurality of fastening holes 112 and 122 provided at each of the first band member 11 and the second band member 12 so that the first and second fixing protrusions are coupled, wherein, in the first band member 11, a through hole 114 through which a portion of the second band member 12 passes is provided so that the second fixing protrusion 123 is fastened to the plurality of fastening holes 112 of the first band member 11.

By using the double fastening part so that the second fixing protrusion 123 of the second band member 12 passes through the through-hole 114 and is fastened to any one of the plurality of fastening holes 112 of the first band member 11 and the first fixing protrusion 113 of the first band member 11 is fastened to any one of the plurality of fastening holes 122 of the second band member 12, the shape of the hairband is formed as illustrated in FIG. 3.

The plurality of fastening holes 112 and 122 may be provided as four fastening holes 112 and four fastening holes 122 and allow, with four levels of size adjustment, the hairband to be adjusted corresponding to different head sizes of users. By eliminating separate additional parts of the related art, such as a band or an O-ring, for making the hairband adjustable, there is an advantage of lowering the manufacturing cost. Also, a rubber band formed of fabric may prevent a smell due to sweat and prevent a problem in terms of hygiene. Although FIG. 2 illustrates a structure in which the plurality of fastening holes 112 and 122 are provided as the four fastening holes 112 and the four fastening holes 122, the present embodiment is not limited thereto, and the number of the plurality of fastening holes 112 and 122 may also be less than four or greater than four.

Also, in the hairband for guiding sweat according to the present invention, because the band part 10 and the sweat guiding part 20 are integrally formed by the mold 1000 or the like and the double fastening part is provided in the band part 10, it is possible to address problems related to damage to parts in the related art, e.g., loss of function of a buckle, a button, a magic tape, or the like, and damage to an O-ring.

Also, by providing the structure in which the second fixing protrusion 123 of the second band member 12 passes through the through-hole 114 and is fastened to the plurality of fastening holes 112 of the first band member 11 and the first fixing protrusion 113 of the first band member 11 is fastened to the plurality of fastening holes 122 of the second band member 12, the hairband for guiding sweat may be prevented from falling down or loosening during use, and, in this way, the hairband may stably maintain a circular shape which fits a head circumference of the user.

Meanwhile, although the structure in which the first fixing protrusion 113 and the second fixing protrusion 123 are each fastened to any one of the plurality of fastening holes 112 and 122 has been described above, the present embodiment is not limited thereto, and a structure in which the first fixing protrusion 113 and the second fixing protrusion 123 are fastened to any one of the plurality of circular holes 111 and 121 may also be used.

Second Embodiment

A hairband for guiding sweat according to a second embodiment of the present invention will be described with reference to FIG. 6. In the description of the second embodiment, only the main configurations that differ from the first embodiment will be described. Description of other configurations identical to those of the first embodiment will be omitted to avoid repetitive description.

Figure 6:
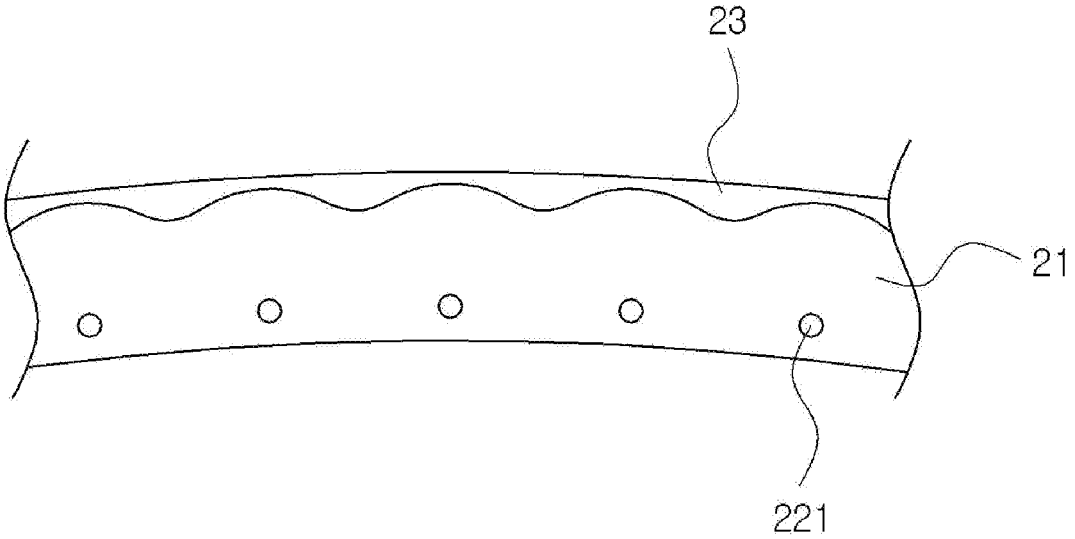
FIG. 6 is a perspective view of a hairband for guiding sweat according to a second embodiment of the present invention.

FIG. 6 is a perspective view of the hairband for guiding sweat according to the second embodiment of the present invention. Only states of a first guiding member 21 and a second guiding member 23 of a sweat guiding part 20 are illustrated.

In the hairband for guiding sweat according to the second embodiment of the present invention, as illustrated in FIG. 6, the sweat guiding part 20 is formed of a central portion and both end portions and formed to be gradually inclined from the central portion toward the both end portions. That is, the sweat guiding part 20 is formed to be inclined 5 to 20° with respect to a band part 10. That is, while the first embodiment has a structure in which the band part 10 and the sweat guiding part 20 are formed to be coplanar and, when wearing the hairband for guiding sweat, the user wears the hairband such that the hairband itself is inclined as illustrated in FIG. 4, in the second embodiment, because the sweat guiding part 20 is formed to be inclined 5 to 20° with respect to the band part 10, the sweat guiding part 20 is formed in a curved shape even when the user wears the hairband in a substantially straight-line shape on the forehead area, and accordingly, a sweat leading part 22 is also formed in a curved shape, thus allowing sweat guided to the sweat leading part 22 to be discharged by being smoothly guided to both end portions of the first guiding member 21.

Meanwhile, the first guiding member 21 may be formed of a central portion and both end portions and formed to be gradually inclined from the central portion toward the both end portions. That is, a ridge at the central portion of the first guiding member 21 may be provided to have substantially the same height as the second guiding member 23, and the ridge of the first guiding member 21 may be provided to be gradually lower than the height of the second guiding member 23 from the central portion toward the both end portions. Specifically, although the first embodiment has the structure in which the ridge of the first guiding member 21 is provided in a straight-line shape, the ridge of the first guiding member 21 may be provided in a curved shape in the second embodiment.

Third Embodiment

A hairband for guiding sweat according to a third embodiment of the present invention will be described with reference to FIG. 7. In the description of the third embodiment, only the main configurations that differ from the first embodiment will be described. Description of other configurations identical to those of the first embodiment will be omitted to avoid repetitive description.

Figure 7:
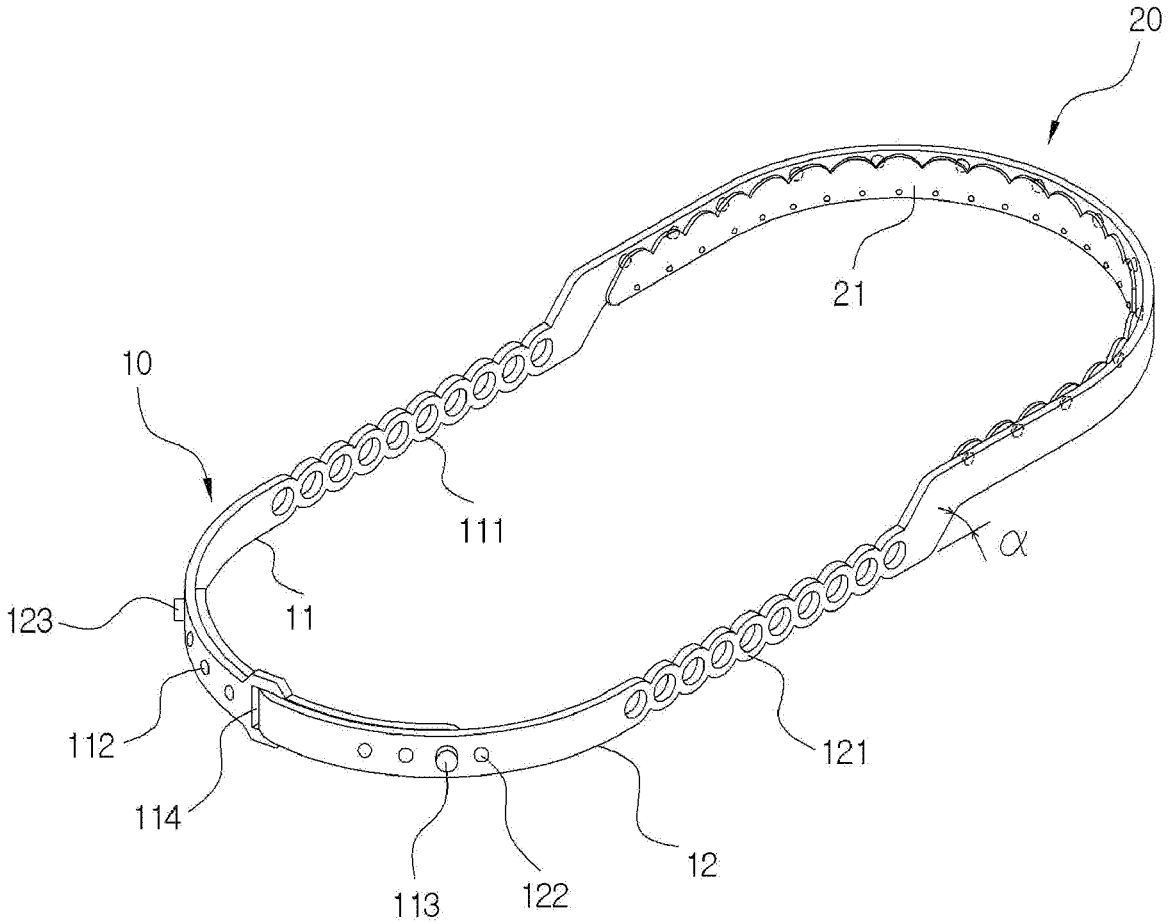
FIG. 7 is a perspective view of a hairband for guiding sweat according to a third embodiment of the present invention.

FIG. 7 is a perspective view of the hairband for guiding sweat according to the third embodiment of the present invention that is viewed from a side.

In the hairband for guiding sweat according to the third embodiment of the present invention, as illustrated in FIG. 7, a sweat guiding part 20 is formed at an angle of inclination a of 10 to 30° with respect to a band part 10. The configurations of the third embodiment are the same as those of the first embodiment except for the sweat guiding part 20 being formed to be inclined with respect to the band part 10.

Forming the sweat guiding part 20 to be inclined with respect to the band part 10 may be easily performed by deforming the shape of the mold 1000 illustrated in FIG. 5.

Therefore, according to the third embodiment, because the sweat guiding part 20 is mounted to be inclined with respect to the band part 10 even when the user wears the hairband for guiding sweat in a substantially straight-line shape, as in the second embodiment, the sweat guided to a sweat leading part 22 may be discharged by being smoothly guided to both end portions of a first guiding member 21.

Fourth Embodiment

A hairband for guiding sweat according to a fourth embodiment of the present invention will be described with reference to FIG. 8. In the description of the fourth embodiment, only the main configurations that differ from the first embodiment will be described. Description of other configurations identical to those of the first embodiment will be omitted to avoid repetitive description.

Figure 8:
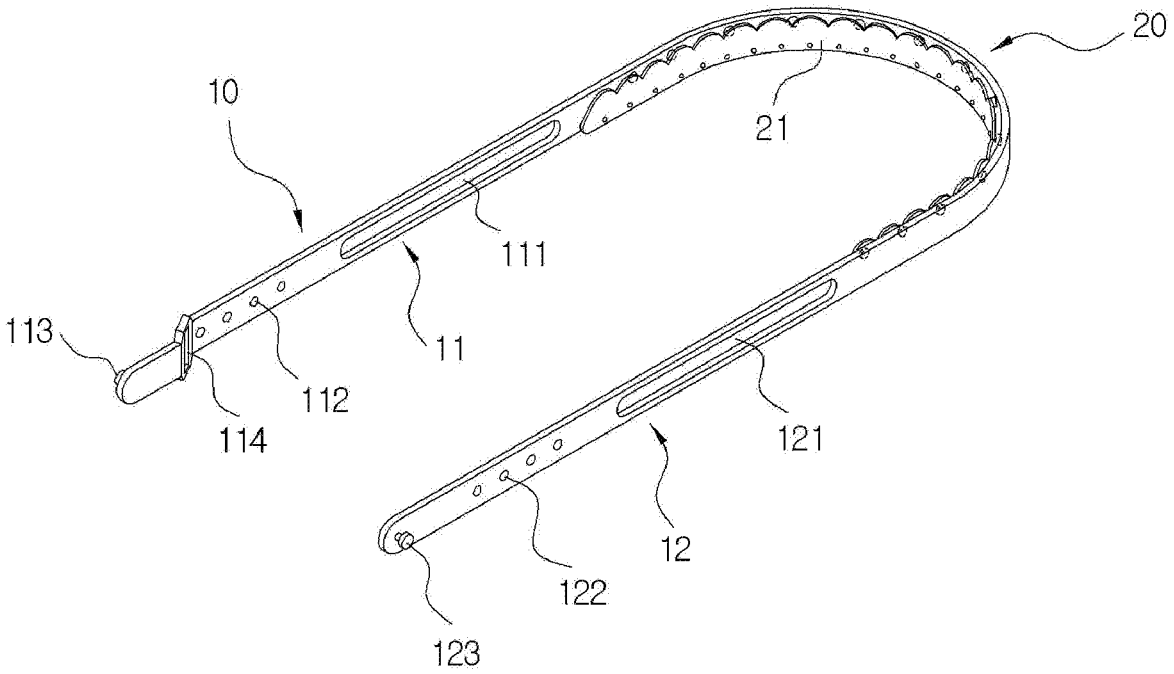
FIG. 8 is a perspective view of a hairband for guiding sweat according to a fourth embodiment of the present invention.

FIG. 8 is a perspective view of the hairband for guiding sweat according to the fourth embodiment of the present invention.

In the hairband for guiding sweat according to the fourth embodiment of the present invention, as illustrated in FIG. 8, one long hole 111 and one long hole 121 are provided in a first band member 11 and a second band member 12, respectively. That is, while the first embodiment has the structure in which ten holes are provided in each of the first band member 11 and the second band member 12 to allow the mounting position of the hairband to be easily adjusted, in the fourth embodiment, one long hole is provided in each of the first band member 11 and the second band member 12 as illustrated in FIG. 8.

Since, unlike in the first embodiment, one long hole 111 and one long hole 121 are provided in the hairband for guiding sweat according to the fourth embodiment of the present invention as described above, a structure of a mold 1000 for integrally forming a band part 10 and a sweat guiding part 20 may be simplified.

Fifth Embodiment

A hairband for guiding sweat according to a fifth embodiment of the present invention will be described with reference to FIG. 9. In the description of the fifth embodiment, only the main configurations that differ from the first embodiment will be described. Description of other configurations identical to those of the first embodiment will be omitted to avoid repetitive description.

Figure 9:
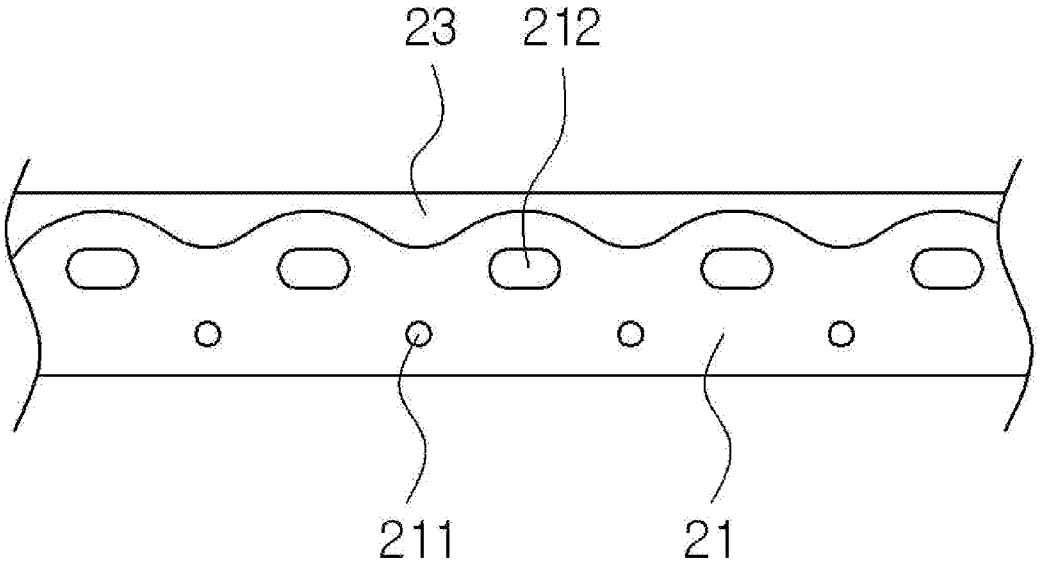
FIG. 9 is a perspective view of a hairband for guiding sweat according to a fifth embodiment of the present invention.

FIG. 9 is a perspective view of the hairband for guiding sweat according to the fifth embodiment of the present invention and illustrates a structure of a first guiding member 21.

In the hairband for guiding sweat according to the fifth embodiment of the present invention, as illustrated in FIG. 9, a plurality of sweat outlets 212 are provided in the first guiding member 21.

That is, as illustrated in FIG. 9, the plurality of sweat outlets 212 are provided at lower portions of portions of the first guiding member 21 where ridges are formed. Also, although FIG. 9 illustrates a structure in which the plurality of sweat outlets 212 are provided at the lower portions of the portions where the ridges are formed, the present embodiment is not limited thereto, and the plurality of sweat outlets 212 may also be provided at portions where valleys are formed.

In the hairband for guiding sweat according to the fifth embodiment of the present invention, by providing the plurality of sweat outlets 212 at the first guiding member 21 pressed against the forehead area of a user as illustrated in FIG. 9, sweat generated at the forehead area on which the first guiding member 21 is mounted may be guided to a sweat leading part 22 through the sweat outlet 212. Accordingly, the user may feel more comfortable wearing the hairband for guiding sweat according to the present invention.

In addition, the structure of the fifth embodiment may also be applied to the above-described structures of the second to fourth embodiments.

Sixth Embodiment

A hairband for guiding sweat according to a sixth embodiment of the present invention will be described with reference to FIG. 10. In the description of the sixth embodiment, only the main configurations that differ from the first embodiment will be described. Description of other configurations identical to those of the first embodiment will be omitted to avoid repetitive description.

Figure 10:
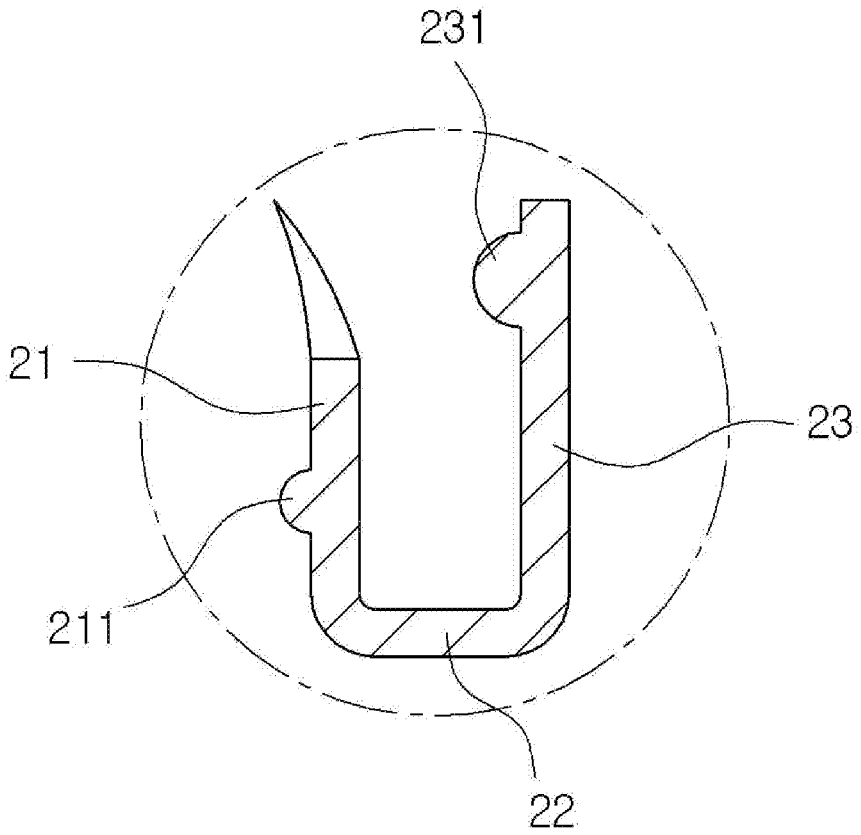
FIG. 10 is a cross-sectional view of a sweat leading part in a hairband for guiding sweat according to a sixth embodiment of the present invention.

FIG. 10 is a cross-sectional view of a sweat leading part in the hairband for guiding sweat according to the sixth embodiment of the present invention and illustrates a structure of a first guiding member 21, which is a modification of the first embodiment.

In the hairband for guiding sweat according to the sixth embodiment, as illustrated in FIG. 10, an upper portion of the first guiding member 21 is provided in a state of being bent outward. By the upper portion of the first guiding member 21 being provided in the state of being bent outward, during use of the hairband, a force of adhesion between the first guiding member 21 and the forehead area of a user is improved, and thus it is possible to further prevent sweat running down from the forehead area from flowing toward an outer side of the first guiding member 21, which is a portion coming in contact with the forehead area of the user.

Seventh Embodiment

A hairband for guiding sweat according to a seventh embodiment of the present invention will be described with reference to FIG. 11. In the description of the seventh embodiment, only the main configurations that differ from the first embodiment will be described. Description of other configurations identical to those of the first embodiment will be omitted to avoid repetitive description.

Figure 11:
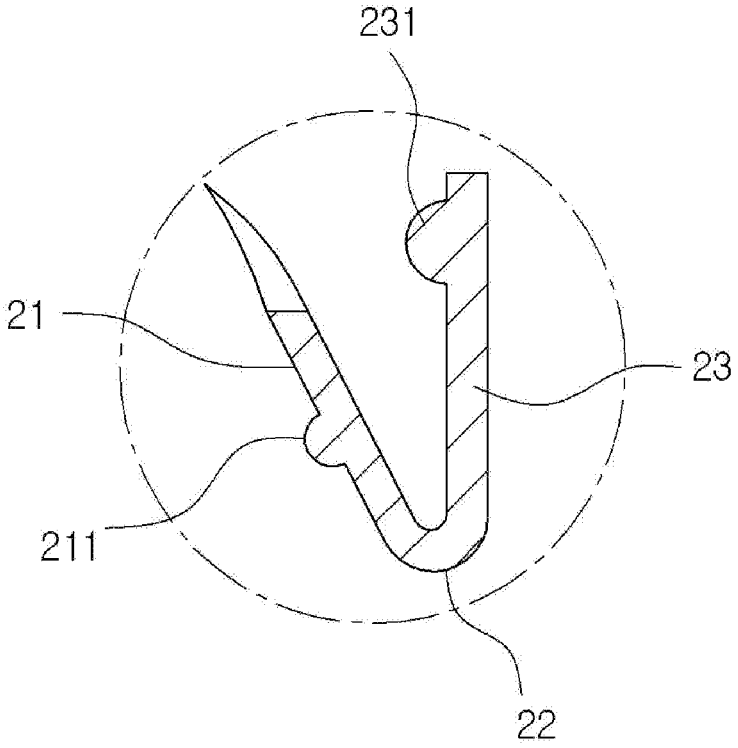
FIG. 11 is a cross-sectional view of both end portions of a first guiding member in a hairband for guiding sweat according to a seventh embodiment of the present invention.

FIG. 11 is a cross-sectional view of both end portions of a first guiding member in the hairband for guiding sweat according to the seventh embodiment of the present invention and illustrates states of a first guiding member 21, a sweat leading part 22, and a second guiding member 23.

The hairband for guiding sweat according to the seventh embodiment has a structure in which a sweat guiding part 20 is formed of a central portion and both end portions and a width of the sweat leading part 22 gradually narrows from the central portion toward the both end portions. That is, the sweat leading part 22 is formed in a substantially U-shape at the central portion of the first guiding member 21 as illustrated in FIG. 2 or 10 and is provided in a substantially V-shape at both end portions of the first guiding member 21 as illustrated in FIG. 11 such that the width of the sweat leading part 22 gradually narrows from the central portion of the first guiding member 21 toward the both end portions thereof.

Therefore, because, when the user wears the hairband for guiding sweat, the both end portions of the first guiding member 21 are pressed against the head area of the user due to the second guiding member 23, a force of adhesion of a sweat guiding part 20 may also be increased at the head area of the user.

Eighth Embodiment

A hairband for guiding sweat according to an eighth embodiment of the present invention will be described with reference to FIG. 12. In the description of the eighth embodiment, only the main configurations that differ from the first embodiment will be described. Description of other configurations identical to those of the first embodiment will be omitted to avoid repetitive description.

Figure 12:
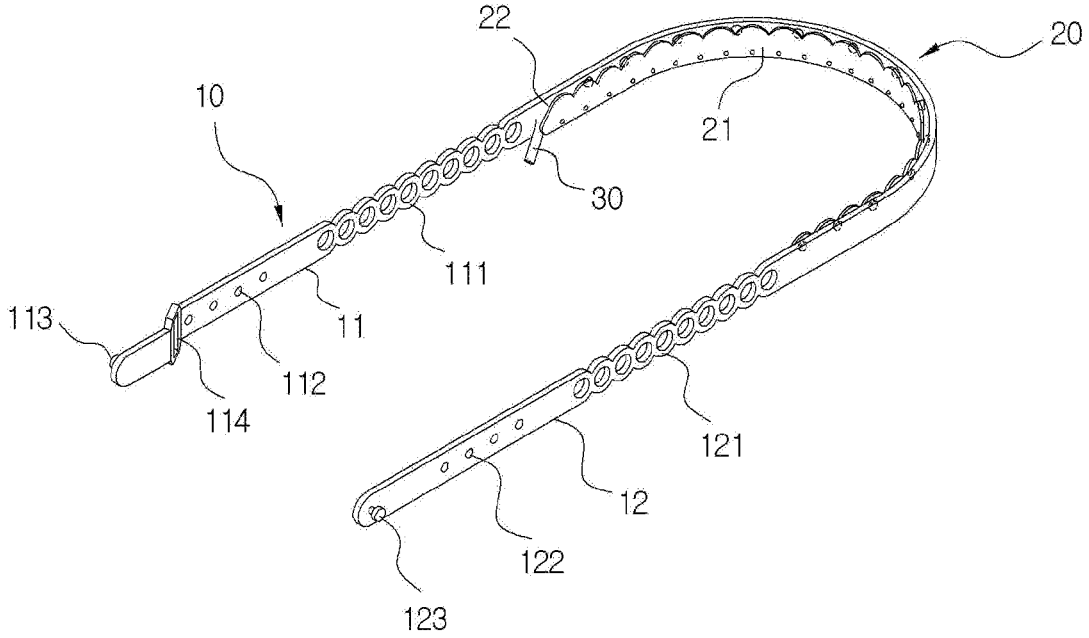
FIG. 12 is a perspective view of a hairband for guiding sweat according to an eighth embodiment of the present invention.

FIG. 12 is a perspective view of the hairband for guiding sweat according to the eighth embodiment of the present invention.

In the hairband for guiding sweat according to the eighth embodiment of the present invention, as illustrated in FIG. 12, a sweat discharging member 30 is provided to be connected to both end portions of a first guiding member 21. The sweat discharging member 30 may be formed so that portions of the first guiding member 21, a sweat leading part 22, and a second guiding member 23 extend from a first band member 11 and a second band member 12 as illustrated in FIG. 12. However, the present embodiment is not limited thereto, and, for example, the sweat discharging member 30 may be formed of an adsorbing material, a synthetic resin material, or plastic and formed in the shape of a straw or a string.

By providing the sweat discharging member 30 in the hairband for guiding sweat according to the eighth embodiment of the present invention as described above, sweat guided to the sweat leading part 22 may be directly discharged to the outside without coming in contact with the user's body, and thus the user may feel more comfortable about sweating.

Ninth Embodiment

A hairband for guiding sweat according to a ninth embodiment of the present invention will be described with reference to FIG. 13. In the description of the ninth embodiment, only the main configurations that differ from the first embodiment will be described. Description of other configurations identical to those of the first embodiment will be omitted to avoid repetitive description.

Figure 13:
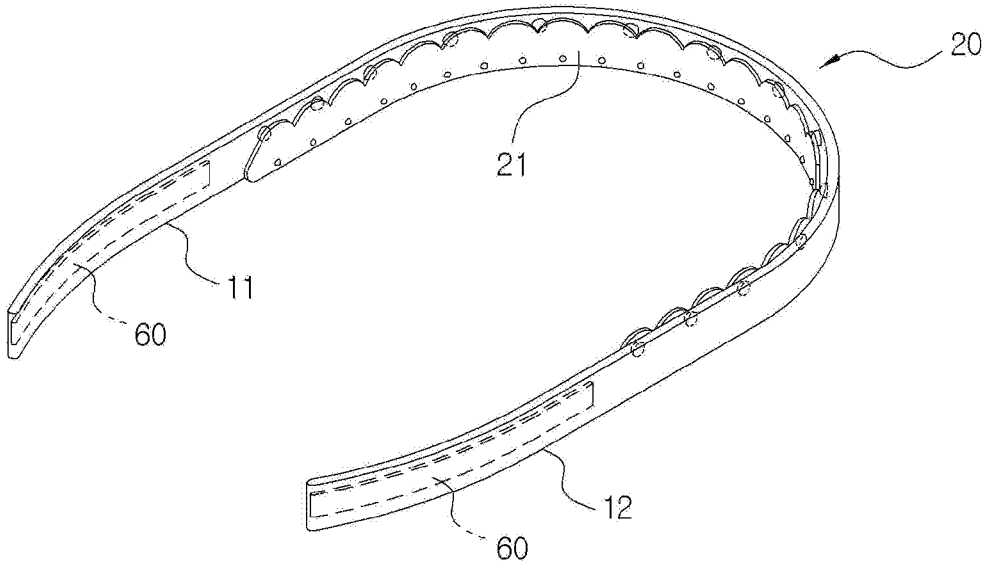
FIG. 13 is a perspective view of a hairband for guiding sweat according to a ninth embodiment of the present invention.

FIG. 13 is a perspective view of the hairband for guiding sweat according to the ninth embodiment of the present invention that is viewed from a side.

In the hairband for guiding sweat according to the ninth embodiment of the present invention, as illustrated in FIG. 13, a structure in which a fastening member is not provided and a portion between a first band member 11 and a second band member 12 is open is provided. That is, a pin 60 formed of a metal material that is capable of maintaining a bent state is inserted into each of the first band member 11 and the second band member 12. As illustrated in FIG. 13, the pin 60 may be easily realized by, when integrally forming a band part 10 and a sweat guiding part 20 by a mold 1000, mounting the pin 60 in advance on portions in the mold 1000 where the first band member 11 and the second band member 12 are to be formed and then forming the band part 10 and the sweat guiding part 20. Also, the pin 60 may have any stiffness or length as long as the pin 60 is able to cause the hairband for guiding sweat to be pressed against the forehead area of a user. The pin 60 is not limited to specific conditions.

Since, as described above, a fastening member is not provided in the hairband for guiding sweat according to the ninth embodiment of the present invention, a mold that is more simplified than the mold for forming the fastening member may be used, and the mounting position of the hairband for guiding sweat may be easily changed according to an intention of the user.

Tenth Embodiment

A hairband for guiding sweat according to a tenth embodiment of the present invention will be described with reference to FIG. 14. In the description of the tenth embodiment, only the main configurations that differ from the first embodiment will be described. Description of other configurations identical to those of the first embodiment will be omitted to avoid repetitive description.

Figure 14:
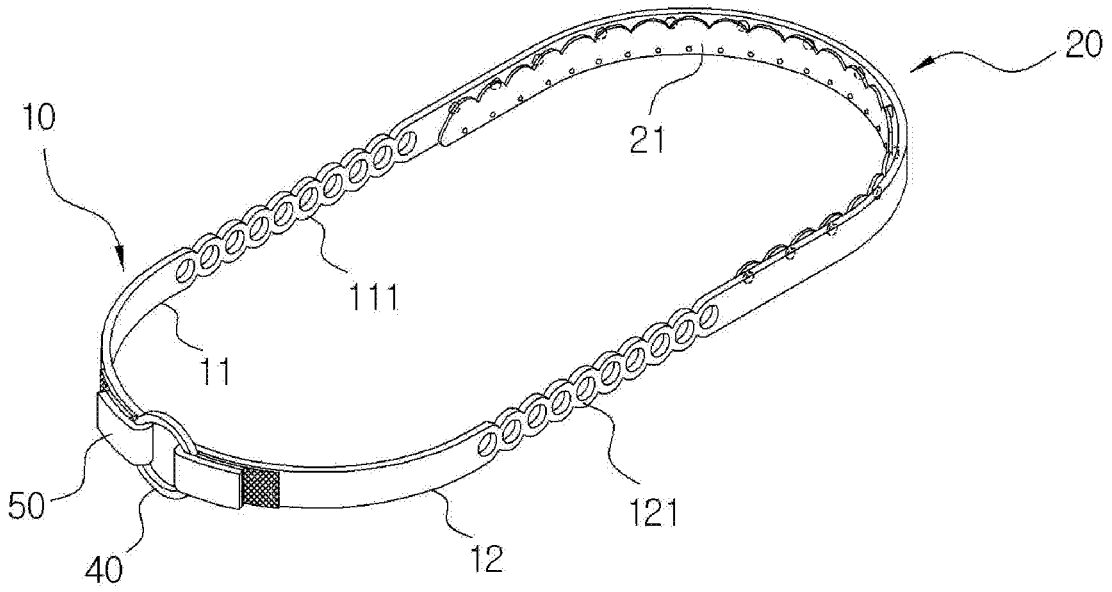
FIG. 14 is a perspective view of a hairband for guiding sweat according to a tenth embodiment of the present invention.

FIG. 14 is a perspective view of a hairband for guiding sweat according to a tenth embodiment of the present invention.

In the hairband for guiding sweat according to the tenth embodiment of the present invention, as illustrated in FIG. 14, as fastening members, an elastic loop member 40 and a strap 50 coupled to the loop member 40 are provided to adjust a mounting position of the hairband, as in the related art. Also, any one of a buckle, a button, and a magic tape may be applied as the strap 50.

In the hairband for guiding sweat according to the tenth embodiment of the present invention, even when, for example, an elastic loop member and a hook fastener are applied as in the related art, because an upper portion of a first guiding member 21 is formed in a wavy shape including ridges and valleys, sweat running down from the forehead area through a gradient having the wavy shape flows from the ridge toward the valley and then flows to a sweat leading part 22. In this way, sweat flow is more smoothly guided than in the related art.

The invention devised by the inventor has been described in detail above according to the embodiments. However, the present invention is not limited to the embodiments, and various modifications are possible within the scope not departing from the gist of the present invention.

INDUSTRIAL APPLICABILITY

By using a hairband for guiding sweat according to the present invention, a manufacturing process can be simplified, and thus a manufacturing cost can be reduced.

The invention claimed is:

1. A hairband for guiding sweat that is elastic and configured to be worn on a forehead area of a user to guide sweat, the hairband comprising:

a fastening member which is mountable on the forehead area of the user by being fastened thereto and includes a first fastening part and a second fastening part;

a band part which includes a first band member including the first fastening part and a second band member including the second fastening part; and a sweat guiding part provided between the first band member and the second band member, wherein the fastening member, the band part, and the sweat guiding part are integrally formed, and wherein the sweat guiding part includes:

a first guiding member whose one side surface presses against the forehead area of the user;

a sweat leading part provided continuously with the first guiding member at a lower portion of the first guiding member; and a second guiding member provided continuously with the sweat leading part while being spaced apart from the first guiding member.

2. The hairband of claim 1, wherein the first band member, the second guiding member, and the second band member are integrally formed continuously with each other.

3. The hairband of claim 1, wherein a height of the second guiding member is formed higher than a height of the first guiding member.

4. The hairband of claim 1, wherein a plurality of first protrusions are provided at a lower portion of an outer side of the first guiding member so that a gap is formed between the forehead area of the user and the first guiding member.

5. The hairband of claim 1, wherein a plurality of second protrusions are provided at an inner side of the second guiding member so that the first guiding member and the second guiding member remain spaced apart from each other.

6. The hairband of claim 1, wherein a width of the sweat leading part at both end portions of the first guiding member is formed narrower than a width of the sweat leading part at a central portion of the first guiding member.

7. The hairband of claim 1, wherein the sweat guiding part includes a central portion and both end portions and is formed to be gradually inclined from the central portion toward the both end portions.

8. The hairband of claim 1, wherein the sweat guiding part is formed to be inclined 5 to 30° with respect to the band part.

9. The hairband of claim 1, wherein a plurality of sweat outlets are provided in the first guiding member.

10. The hairband of claim 1, wherein an upper portion of the first guiding member is formed in a wavy shape including ridges and valleys.

11. The hairband of claim 10, wherein:

the ridge of the wavy shape has the same height as the second guiding member; and the valley of the wavy shape is provided to be lower than the second guiding member.

12. The hairband of claim 1, wherein the fastening member performs double fastening to mount the hairband on the forehead area of the user.

13. The hairband of claim 12, wherein the fastening member includes a first fixing protrusion formed at an end portion of the first band member, a second fixing protrusion formed at an end portion of the second band member, and a plurality of fastening holes provided at each of the first band member and the second band member so that the first and second fixing protrusions are coupled, wherein, in the first band member, a through hole through which a portion of the second band member passes is provided so that the second fixing protrusion is fastened to the plurality of fastening holes of the first band member.

14. The hairband of claim 1, wherein at least one hole is provided in each of the first band member and the second band member so as to allow a mounting position of the hairband to be easily adjusted.

15. The hairband of claim 14, wherein both end portions of the first guiding member are provided to be adjacent to the holes each provided in the first band member and the second band member.

16. The hairband of claim 2, wherein a sweat discharging member is connected to both end portions of the sweat leading part.

17. The hairband of claim 10, wherein the upper portion of the first guiding member is bent outward.

18. The hairband of claim 1, wherein the band part and the sweat guiding part are formed of rubber or resin having elasticity.

* * * * *